US006544203B2

(12) United States Patent
Hazard

(10) Patent No.: US 6,544,203 B2
(45) Date of Patent: Apr. 8, 2003

(54) APPARATUS AND METHOD FOR CONTINUOUS PASSIVE MOTION OF THE LUMBAR REGION

(75) Inventor: Rowland G. Hazard, Burlington, VT (US)

(73) Assignee: Ergomedics, Inc., Winooski, VT (US)

( * ) Notice: Subject to any disclaimer, the term of this patent is extended or adjusted under 35 U.S.C. 154(b) by 0 days.

(21) Appl. No.: 09/757,979

(22) Filed: Jan. 10, 2001

(65) Prior Publication Data

US 2002/0091345 A1 Jul. 11, 2002

(51) Int. Cl.[7] ..... A61H 9/00
(52) U.S. Cl. ..... 601/150; 601/148
(58) Field of Search ..... 601/148–152; 600/587, 594

(56) References Cited

U.S. PATENT DOCUMENTS

| | | | | | |
|---|---|---|---|---|---|
| 4,833,614 | A | | 5/1989 | Saitoh et al. | |
| 4,981,131 | A | * | 1/1991 | Hazard | 601/148 |
| 4,986,260 | A | | 1/1991 | Iams et al. | 128/24 |
| 5,135,282 | A | | 8/1992 | Pappers | 297/284 |
| 5,211,162 | A | | 5/1993 | Gillen, Jr. et al. | 128/64 |
| 5,529,573 | A | | 6/1996 | Kelly et al. | 601/34 |
| 5,558,398 | A | * | 9/1996 | Santos | 297/284.3 |
| 5,562,604 | A | | 10/1996 | Yablon et al. | 601/148 |
| 5,637,076 | A | * | 6/1997 | Hazard et al. | |
| 5,848,982 | A | * | 12/1998 | Hoshino et al. | 601/150 |
| 6,098,000 | A | * | 8/2000 | Long et al. | |
| 6,296,617 | B1 | * | 10/2001 | Peeler et al. | 601/152 |

* cited by examiner

*Primary Examiner*—Justine R. Yu
(74) *Attorney, Agent, or Firm*—Choate, Hall & Stewart

(57) ABSTRACT

Apparatus and method for continuous passive motion back support for a person comprising a fluid-inflatable bag disposed between a static structure and the back of a person, the fluid-inflatable bag including a back-engaging surface cyclically moveable to increase and decrease the distance between the static structure and the back-engaging surface thereby to cycle the lower back through a substantial range of lordosis, a conduit adapted to conduct the fluid between the reservoir or the atmosphere and the fluid-inflatable bag, and programmable circuitry for adjusting a voltage supplied to an electrically-powered pump, whereby fluid flow in the conduit is effected by adjustably operating the electrically-powered pump. Various multiple bag embodiments are disclosed. Also disclosed is an apparatus and method for providing a baseline support pressure during continuous passive motion for the lower back of a person.

32 Claims, 10 Drawing Sheets

APPARATUS AND METHOD FOR CONTINUOUS PASSIVE MOTION OF THE LUMBAR REGION

FIELD OF THE INVENTION

The invention relates generally to an apparatus and method for providing continuous passive motion support to the back of a person for preventing or treating lower back pain. More particularly, the invention provides pneumatic fluid pressure means for cycling the lumbar region through a substantial range of lordosis. One or more fluid inflatable bags are cyclically inflated and deflated by means of an electrically powered pump. Programmable circuitry controls the operation of the pump by adjusting the pump supply voltage. In another embodiment, one or more of the fluid inflatable bags provide static baseline support pressure while the same or other bags provide continuous passive motion support to the back of a person.

BACKGROUND OF THE INVENTION

This invention relates generally to a method and apparatus for providing continuous passive motion to the lumbar region of the spine.

The inventor herein has been issued three patents related to continuous passive motion (CPM), the teachings of which are herein incorporated by reference. U.S. Pat. No. 4,981,131 (hereinafter "the '131 patent") disclosed apparatus for cycling the lumbar region of the spine through a substantial range of lordosis (forward spinal curvature) for the purpose of preventing and relieving low back pain. In that patent, an inflatable bladder in contact with the back is pressurized and depressurized to effect the substantial range of lordosis. U.S. Pat. No. 5,624,383 (hereinafter "the '383 patent") disclosed an apparatus and method for providing force feedback in continuous passive motion (CPM) systems, whereby a force measuring apparatus is provided for continuously measuring the force exerted by a force-applying mechanism on a person's lumbar area and a system controls the force exerted by the mechanism in order to build up to a predetermined upper force range, which is maintained during an 'on cycle' to provide force on the lumbar area of the user. U.S. Pat. No. 5,637,076 (hereinafter "the '076 patent") disclosed the ability to measure and control the force applied to the person's back throughout the inflate and deflate cycles to accommodate variations in a person's spinal compliance, posture and position during the spinal mobilization.

As discussed in detail in the '131 patent, research indicates that CPM of the lower back, or lumbar, region of a person through a substantial range of lordotic movement ameliorates lower back pain. Such motion is not massage, which relates merely to superficial tissues, such as might be produced by duration intervals shorter than five seconds, but constitutes motion of vertebrae with respect to one another. That patent disclosed controlling an inflation and deflation of a bladder by opening and closing two sequential valves 10, as shown in FIGS. 1*a* and 1*b*, while a pump 11 is working continuously, to control a flow of a fluid through a conduit. FIG 1*a* illustrates the positions of the two sequential valves 10 necessary to inflate the bladder, and FIG. 1*b* illustrates the positions of the two sequential valves 10 necessary to deflate the bladder.

There was no provision, however, in those patents for adjustably controlling the operation of a pump providing a cyclic pneumatic inflation pressure. The '131 patent disclosed controlling CPM fluid flows by directing valves in the system to alternately shunt fluid from a constant pressure source (a continuously operating pump) toward and then away from the support bladder. The '076 patent disclosed, additionally, only an apparatus for turning on a pump to increase the pressure, and turning off the pump and allowing air to flow out of the inflation bladder to induce deflation. Therefore, in order to provide maximal comfort to a user while achieving the desired ranges of spinal motion, better control of the inflation rate is needed. Furthermore, a need exists for additional means to reduce the workload of the pump in order to prolong its life while providing continuous passive motion to the lumbar region of a person.

Nor was there any a provision in those patents for providing a minimum static baseline support pressure. Through extensive experience with CPM technology, the inventor has discovered that individual users require or prefer varying amounts of maximum and minimum inflation pressures, inflation and deflation rates, and lengths of inflation and deflation cycle intervals. Need, therefore, exists to allow users to select and achieve maximum benefit and comfort by controlling cycle parameters such as the inflation and deflation rates and durations, as well as the maximum inflation and minimum baseline support pressures between which CPM would be delivered.

SUMMARY OF THE INVENTION

It is an object of the invention to address the needs described above. The invention disclosed herein is a system and method for continuous passive motion back support for a person while seated or supine. The apparatus cycles the back of the person through a substantial range of lordosis. It comprises a substantially static structure adjacent to the back of the person, a fluid-inflatable bag disposed between the static structure and the person's back, wherein the fluid-inflatable bag includes a back-engaging surface cyclically moveable to increase and decrease the distance between the static structure and the back-engaging surface, an electrically-powered pump connected to a reservoir or the atmosphere for supplying a fluid to the fluid-inflatable bag, a conduit adapted to conduct the fluid between the reservoir or the atmosphere and the fluid-inflatable bag, and programmable circuitry for adjusting a voltage supplied to the electrically-powered pump, whereby fluid flow in the conduit is effected by adjustably operating the electrically-powered pump. The fluid is preferably air, but could comprise any gaseous or gas mixture, or any liquid, such as, for example, water.

In one embodiment, the programmable circuitry is further comprised of a control panel adapted to receive user-adjustable cycle parameters. In a preferred embodiment, the programmable circuitry adjusts the voltage supplied to the electrically-powered pump in a manner responsive to the user-adjustable cycle parameters. The user-adjustable cycle parameters could include a duration of an inflation and deflation cycle, a rate of inflation, and/or an inflation pressure. The programmable circuitry may adjust the voltage supplied to the electrically-powered pump by modulating the pulse width of the voltage. Alternatively, the programmable circuitry may adjust the voltage by use of a potentiometer.

In another embodiment, the apparatus includes a check valve to protect against inappropriate entrance of fluid into the system through the conduit. The apparatus may additionally be equipped with a valve adapted for adjustably limiting a rate of fluid flow in the conduit during inflation.

In another embodiment, the apparatus may also include a transducer adapted to monitor the force exerted by the back-engaging surface on the back of the person and to transmit an output regarding the force to the programmable circuitry. The programmable circuitry may then adjust the voltage supplied to the electrically-powered pump in response to the output transmitted from the transducer, whereby the programmable circuitry regulates the flow of the fluid in the conduit. The programmable circuitry may include a timer for timing an inflation interval and/or a deflation interval.

In another embodiment, the apparatus includes an exhaust conduit adapted to conduct the fluid between the conduit and the reservoir or atmosphere through a solenoid valve. The programmable circuitry may regulate the flow of the fluid in the exhaust conduit by additionally closing the solenoid valve, thereby regulating inflation of the fluid-inflatable bag. And the programmable circuitry may additionally open the solenoid valve, thereby regulating deflation of the fluid-inflatable bag.

Also disclosed is a method for providing continuous passive motion back support for a person, comprising the steps of: providing a fluid-inflatable bag having a force-applying portion connected to an electrically-powered pump for inflating the fluid-inflatable bag; positioning the fluid-inflatable bag behind and adjacent to the lumbar region of the person, the force-applying portion of the fluid-inflatable bag adjacent to the back of the person when so positioned; and cyclically inflating the fluid-inflatable bag by adjusting a voltage supplied to the electrically-powered pump pumping fluid into the fluid-inflatable bag and deflating the fluid-inflatable bag by allowing fluid to flow out from the fluid-inflatable bag, thereby cyclically varying forces applied to the spine of the person moving the spine through a substantial range of extents of lordosis.

In another embodiment, the invention provides a baseline support pressure while treating or preventing low back pain. In this embodiment, the invention comprises a fluid-inflatable bag having a force-applying portion, the bag adapted to be positioned behind and adjacent the lumbar region of the person, the force-applying portion adjacent to the lumbar region of the spine when the bag is so positioned, a source of fluid under pressure, a conduit adapted to conduct the fluid between the source and the bag, a control panel adapted to receive a user-selected baseline pressure, a regulator adapted for automatically controlling flow of the fluid in the conduit, the flow of the fluid cyclically causing inflation and deflation of the bag, the regulator thereby controlling the pressure of the fluid in the bag, the inflation and deflation of the bag thereby cyclically moving the spine through a substantial range of extents of lordosis, the regulator further adapted to prevent the pressure of the fluid in the bag from dropping below the user-selected pressure.

The invention may provide continuous passive motion back support by the use of multiple fluid-inflatable bags. In such an embodiment, the invention comprises a substantially static structure adjacent to the back of a person, two or more fluid-inflatable bags disposed between the static structure and the back of a person, the fluid-inflatable bags each including a back-engaging surface independently and cyclically moveable to increase and decrease the distance between the static structure and each back-engaging surface thereby to cycle the lower back through a substantial range of lordosis, a pump connected to a reservoir or the atmosphere for supplying a fluid to the fluid-inflatable bags, a number of supply conduits adapted to conduct the fluid between the reservoir or the atmosphere and the two or more fluid-inflatable bags, at least one exhaust conduit adapted to conduct the fluid between the two or more fluid-inflatable bags and the reservoir or the atmosphere, a number of solenoid valves equal to a number of the two or more fluid-inflatable bags for which independent inflation control is desired, the number of solenoid valves disposed between the number of supply conduits and the at least one exhaust conduit, and programmable circuitry adapted to control operation of the pump and independently the number of solenoid valves, thereby controlling flow of the fluid in the number of supply conduits and the at least one exhaust conduit, the flow of the fluid cyclically causing inflation and deflation of the two or more fluid-inflatable bags, the programmable circuitry thereby controlling the pressures of the fluid in the two or more fluid-inflatable bags. The pump may further comprise an electrically-powered pump supplied with a voltage. And the programmable circuitry may control the pump by either turning the pump on or off, or alternatively by adjusting the voltage supplied to the electrically-powered pump.

The multiple fluid-inflatable bag embodiment may also include programmable circuitry comprised of a control panel adapted to receive user-adjustable cycle parameters for each of the two or more fluid-inflatable bags. And the programmable circuitry may adjust the voltage supplied to the electrically-powered pump in a manner responsive to the user-adjustable cycle parameters. As in the single bag embodiments, the user-adjustable cycle parameters may include, for each of the bags, a duration of an inflation and deflation cycle, a rate of bag inflation, and/or an inflation pressure. The multiple fluid-inflatable bag embodiment may also provide a baseline support pressure by adjusting the inflation cycle of one or more of the bags to a maximum, whereby the one or more bags provides a static baseline support pressure to the back of the person, and the other bag(s) continues to provide continuous passive motion support.

In a preferred embodiment, the invention comprises three fluid-inflatable bags arranged in a layered manner perpendicular to the back of the person, wherein the middle of the three bags provides static baseline support pressure to the back of the person. Either of the outer bags, preferably the bag adjacent to the lower back of the person, may provide continuous passive motion above the baseline support pressure. The three bags may additionally be incorporated into a support structure, such as a flippable mattress.

The invention disclosed herein also includes a method for providing a static baseline support pressure during continuous passive motion for the back of a person. The method is comprised of the steps of providing a fluid-inflatable bag including a force-applying portion connected to a pump for inflating the fluid-inflatable bag with a flow of a fluid supplied from a reservoir or the atmosphere through a conduit, providing programmable circuitry adapted to control operation of the pump, positioning the fluid-inflatable bag behind the lumbar region of the person, the fluid-inflatable bag being adjacent to the lumbar region of the person with its force-applying portion adjacent to the lumbar region of the spine of the person when so positioned, inflating the fluid-inflatable bag to a desired minimum support pressure with the fluid pumped by the pump, and controlling the operation of the pump by means of the programming circuitry, thereby controlling a cyclic flow of the fluid in the conduit and a cycle of inflation of the fluid-inflatable bag and deflation to no less than the desired minimum support pressure, thereby cyclically varying forces applied to the spine of the person moving the spine through a substantial range of extents of lordosis while providing a baseline support pressure in the bag.

DETAILED DESCRIPTION

Preferred embodiments of the invention will now be described with reference to the accompanying drawings.

Voltage-Controlled Continuous Passive Motion

Figure 1A:
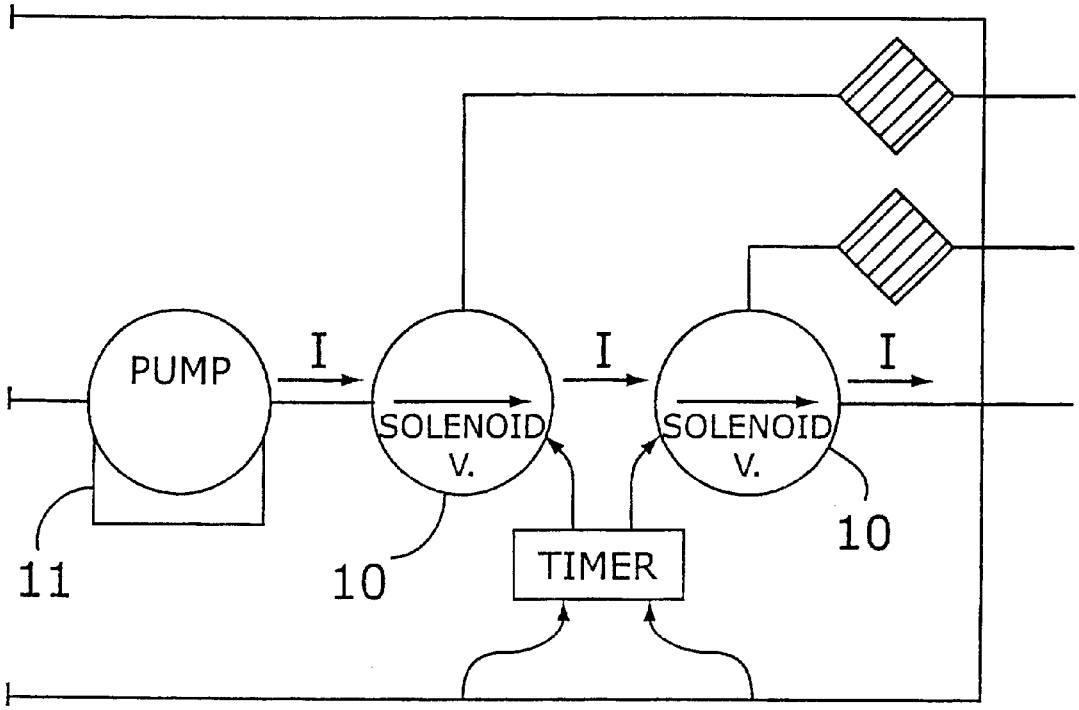
FIG. 1*a* is a schematic diagram of a two-solenoid-valve embodiment of an apparatus for providing continuous passive motion to the lower back of a person, showing pump and valves operation during an inflation interval.
Figure 1B:
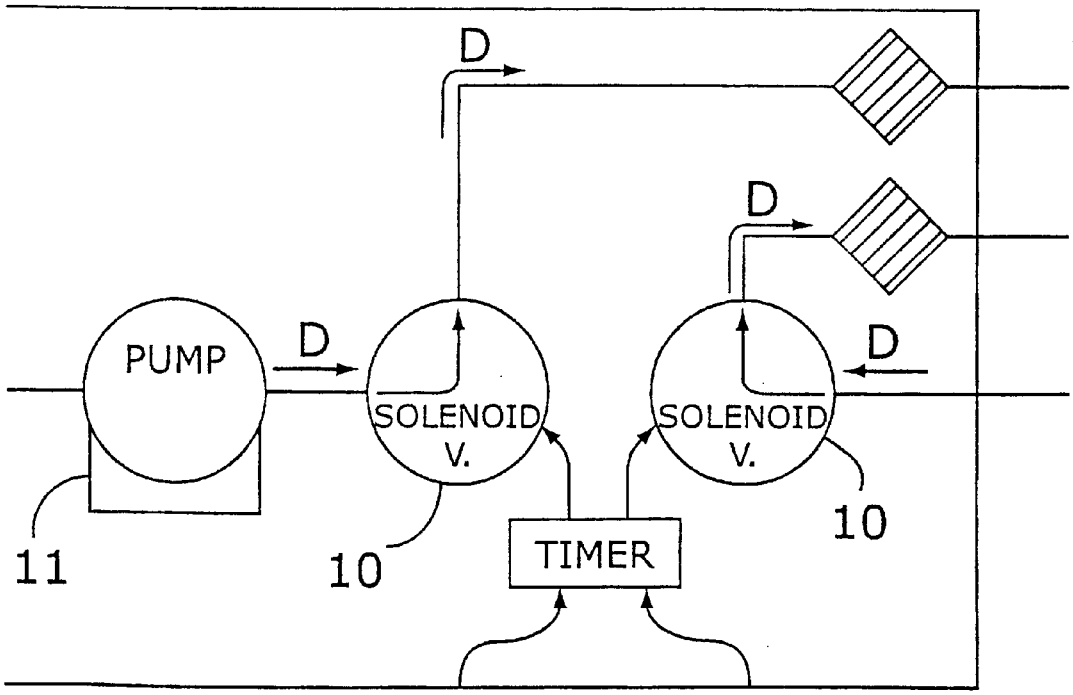
FIG. 1*b* is a schematic diagram of a two-solenoid-valve embodiment of an apparatus for providing continuous passive motion to the lower back of a person, showing pump and valves operation during a deflation interval.
Figure 2:
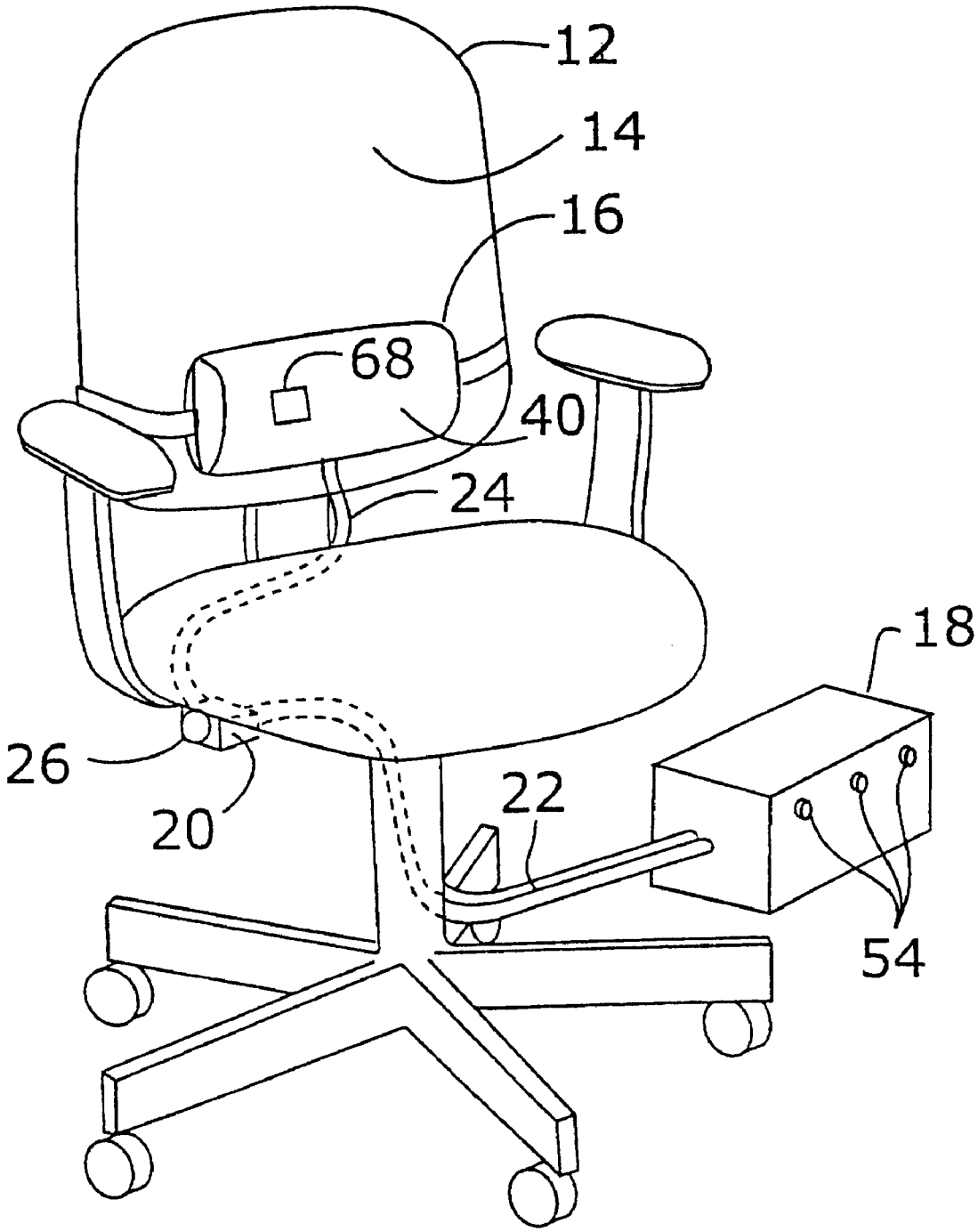
FIG. 2 is a perspective view of an apparatus for providing continuous passive motion to the lower back of a person in a seated embodiment.

Illustrated in FIG. 2 is an apparatus for providing cyclic passive motion back support, arranged in a seated configuration with a standard chair 12 that includes a back 14. The back support apparatus includes a fluid inflatable bag 16, which is affixed to the chair back 14; fluid supply 18; variable pressure release valve 20; and conduits 22 and 24, which conduct air between, respectively, fluid supply 18 and pressure release valve 20, and pressure release valve 20 and the fluid inflatable bag 16. Variable pressure release valve 20 is of the precision pressure regulator type, well known in the pneumatics art, and includes adjustment knob 26, by which a user may adjust a fluid delivery rate to the fluid inflatable bag 16 by regulating the flow of fluid through conduits 22 and 24. Preferably, the fluid employed in the invention is air.

Figure 3:
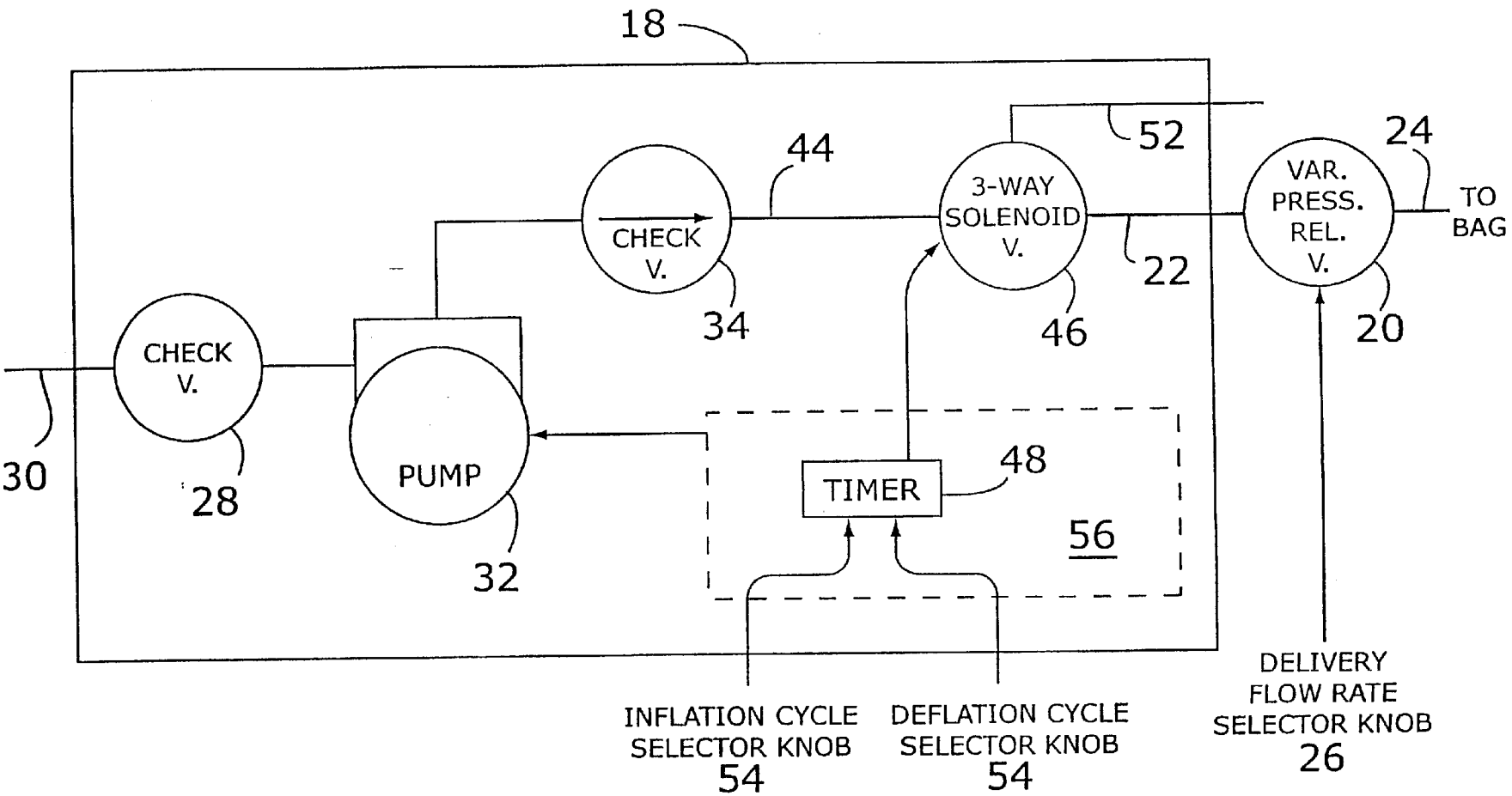
FIG. 3 is a schematic diagram of an apparatus for providing continuous passive motion to the lower back of a person.
Figure 4B:
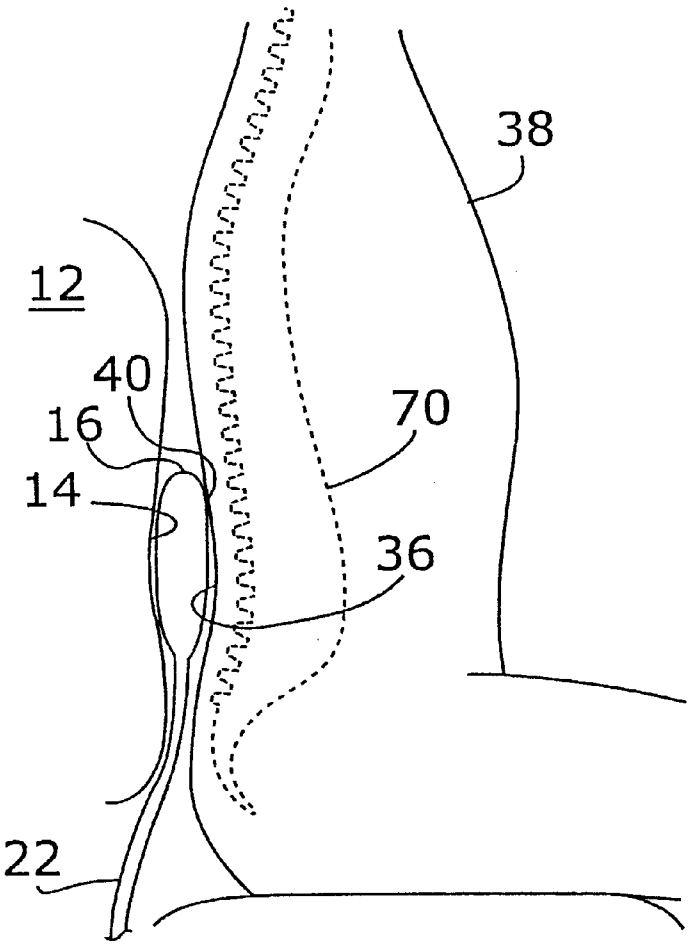
FIG. 4*b* is a perspective view showing a deflated bag.
Figure 4A:
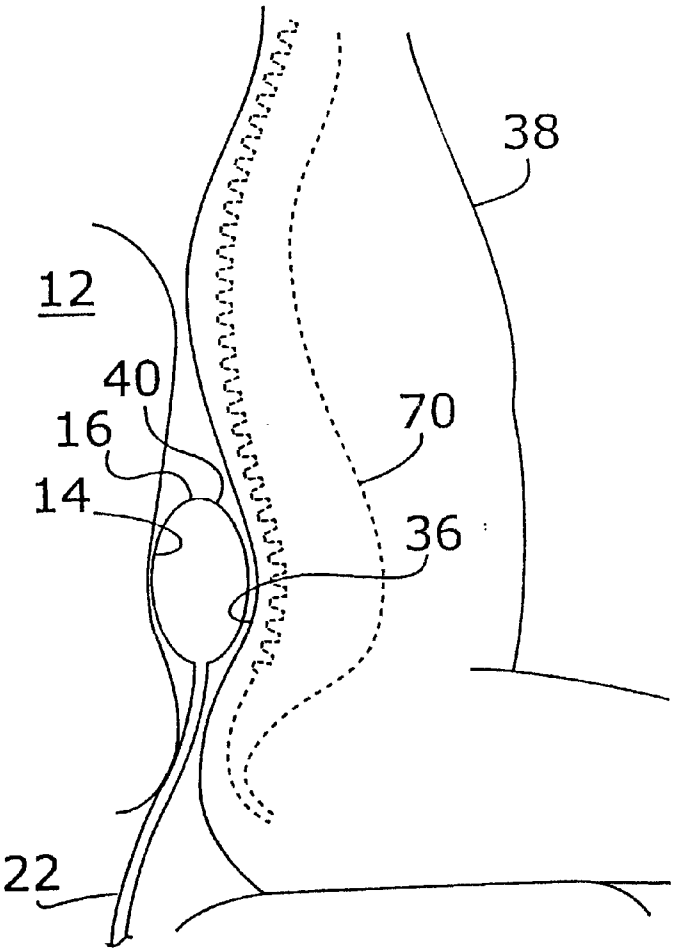
FIG. 4*a* is a perspective view showing a inflated bag.

Referring to FIG. 3, an aspect of the invention is a fluid supply 18 that may include a check valve 28 to protect against inappropriate entrance of fluid from a reservoir or the atmosphere into conduit 22. The fluid supply 18 includes a conduit 30 from the atmosphere or reservoir to an electrically powered pump 32 that can force fluid through a one-way check valve 34, conduit 44, conduits 22 and 24, to the fluid inflatable bag 16. Referring to FIGS. 4*a* and 4*b*, the fluid inflatable bag 16 is situated nearly adjacent to the lower back 36 of a person 38 sitting in the chair 12 or lying on a horizontal surface 42 (as depicted in a supine embodiment depicted in FIG. 5). The fluid inflatable bag 16 includes a back engaging surface 40 cyclically moveable to increase or decrease (as depicted in FIGS. 4*a* and 4*b* respectively) distance between the chair back 14 (or horizontal surface 42 in FIG. 5) and the back engaging surface 40 thereby cycling the lower back 36 through a substantial range of lordosis. Conduit 44 passes through a solenoid valve 46, to the fluid inflatable bag 16 or alternatively to the atmosphere or reservoir through exhaust 52. Solenoid valve 46, under control of timer 48, either (during an inflation interval) directs the fluid (as shown generally by arrows I in FIG. 6*a*) from electrically powered pump 32 to conduit 22, or (during a deflation interval) directs the fluid (as shown generally by arrows D in FIG. 6*b*) from conduit 22 to the atmosphere via exhaust 52. Solenoid valve 46 is preferably of the 3-way solenoid normally open type, such as the Rostra Engineered 3-Way Vacuum Solenoid. Timer 48, coupled electrically with the solenoid which operates the valve in solenoid valve 46, preferably can be adjusted by the user by means of interval selector knobs 54 to determine the durations of the inflation interval and the deflation interval individually and independently. The fluid supply 18 additionally includes programmable circuitry 56 (illustrated in FIG. 7) capable of adjusting a voltage 58 supplied to the electrically powered pump 32, and controlling operation of solenoid valve 46.

The applicant's invention improves in several ways upon the design of the previously disclosed apparatus. Rather than relying upon continuous operation of a pump, as envisioned in the '131 patent, the applicant has developed various methods for controlling an electrically powered pump 32, and thereby the flow of fluid through conduits 22 and 24, and the duration of an inflation cycle and duration of a deflation cycle. Cyclically turning the electrically powered pump 32 on and off, and controlling the opening and closing of the solenoid valve 46, provides control over the durations of inflation and deflation, as well as a maximum delivery pressure within the fluid inflatable bag 16. Pump types contemplated are of piston diaphragm and rotary vane designs known in the art.

Figure 8A:
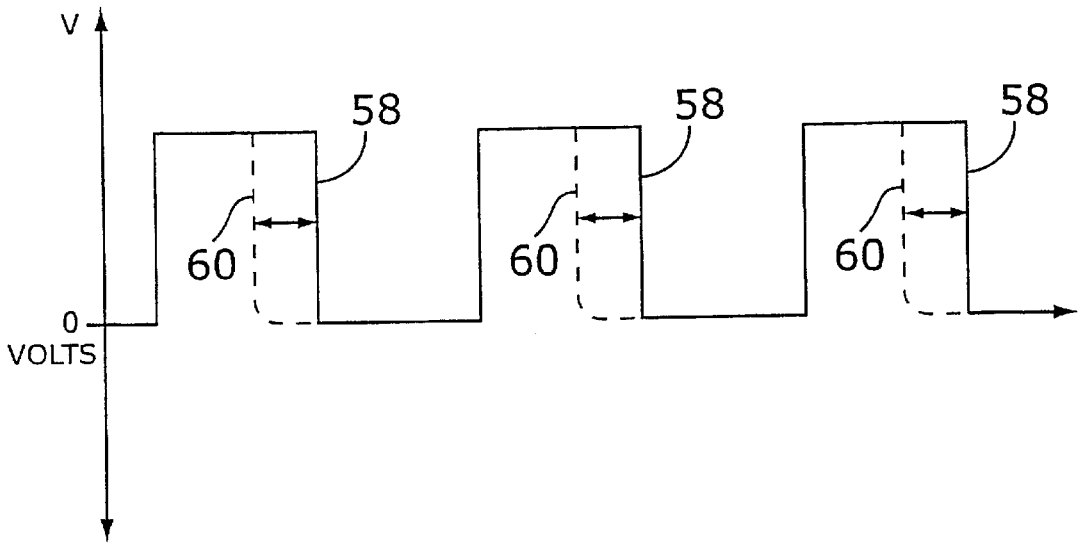
FIG. 8*a* is an illustration representing supply voltage adjustment through pulse width modulation.
Figure 8B:
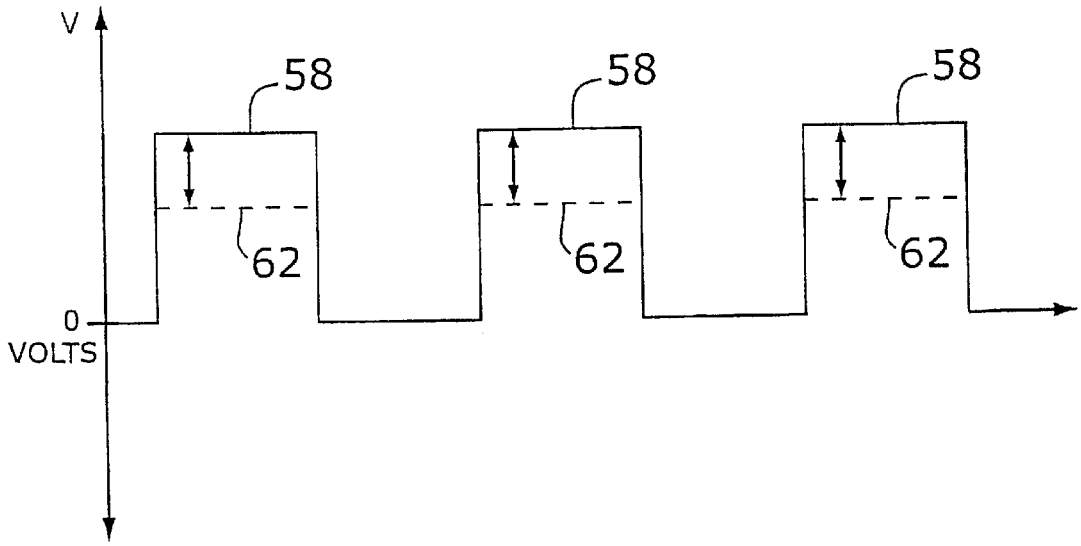
FIG. 8*b* is an illustration representing supply voltage adjustment through use of a potentiometer.

In one aspect of the invention, the workload of the electrically powered pump 32 may be controlled by adjusting the voltage 58 supplied to the electrically powered pump 32. The voltage 58 may be adjusted through pulse width modulation, as represented by adjusted voltage 60 depicted in FIG. 8*a*. Alternatively, the voltage 58 may be adjusted through use of a potentiometer, such as a radial or board mounted potentiometer, reulting in an adjusted voltage 62 as depicted in FIG. 8*b*.

Figure 6A:
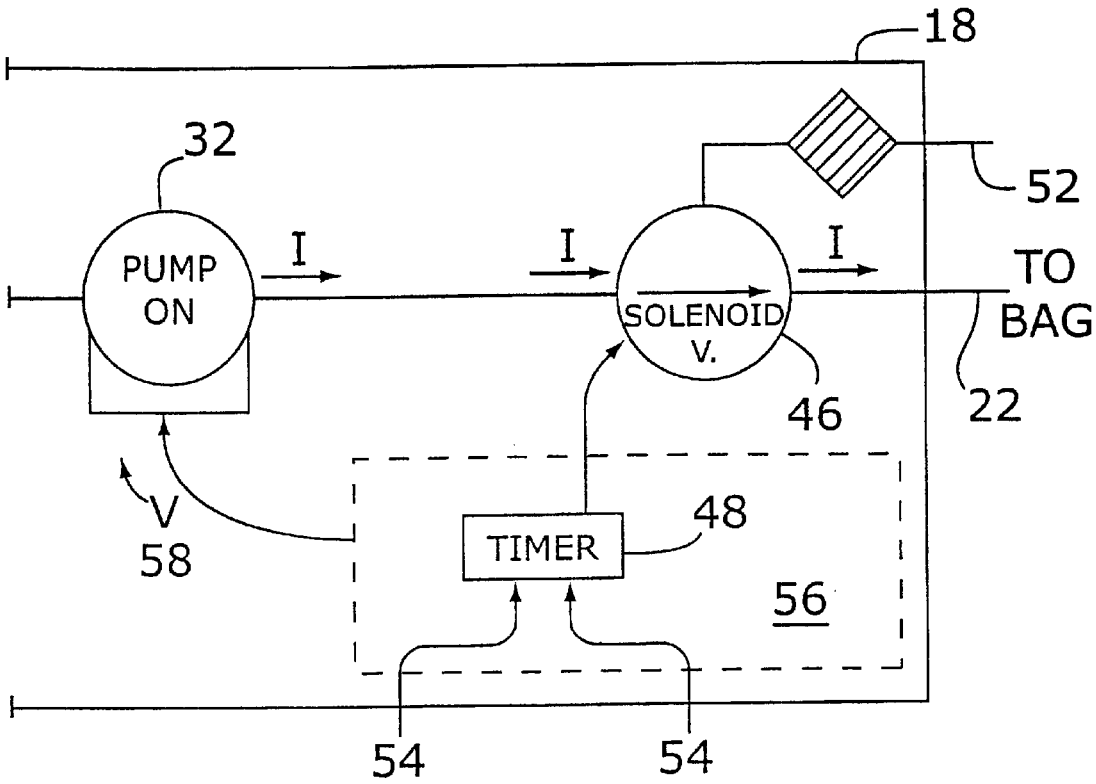
FIG. 6*a* is a schematic diagram demonstrating valve and pump operation, and fluid flow during a fluid inflatable bag inflation interval.
Figure 6B:
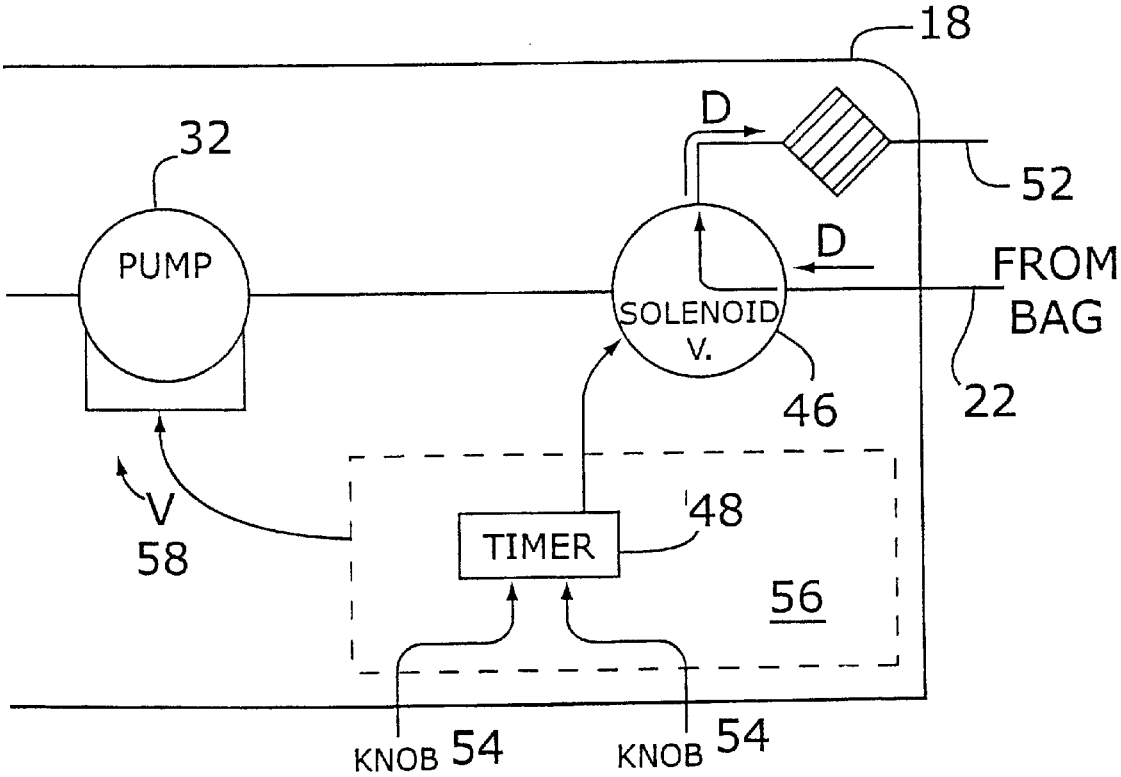
FIG. 6*b* is a schematic diagram demonstrating valve and pump operation, and fluid flow during a fluid inflatable bag deflation interval.

Eliminating continuous operation of the electrically powered pump 32 obviates the necessity of two three-way solenoid valves, as disclosed in the applicant's prior continuous passive motion patents, requiring instead only one solenoid valve 46. As illustrated in FIG. 6*a*, during an inflation interval, the electrically powered pump 32 is operating and solenoid valve 46 is closed, therefore fluid flows into the fluid inflatable bag 16. As illustrated in FIG. 6*b*, during a deflation interval the electrically powered pump 32 is turned off and solenoid valve 46 is opened, thereby allowing the fluid to flow from the fluid inflatable bag 16 through an exhaust 52 to the atmosphere or reservoir. Adding control of the electrically powered pump 32 to the control of solenoid valve 46 allows a user better selection of inflation and deflation cycle parameters most comfortable for the user's body size, stiffness, position or other characteristics. Reducing the workload of the electrically powered pump 32 will reduce wear and prolong useful life of the apparatus. Various combinations of inflation fluid flow, duration and, therefore, inflation rate and maximum delivery pressure can be achieved, corresponding to cycle parameters preferably set by a user, or alternatively to preprogrammed coordinated settings of supply voltage and duration of operation. The amount of deflation that the fluid inflatable bag 16 experiences may be controlled by adjusting the duration that the electrically powered pump 32 is off and solenoid valve 46 is open.

Figure 7:
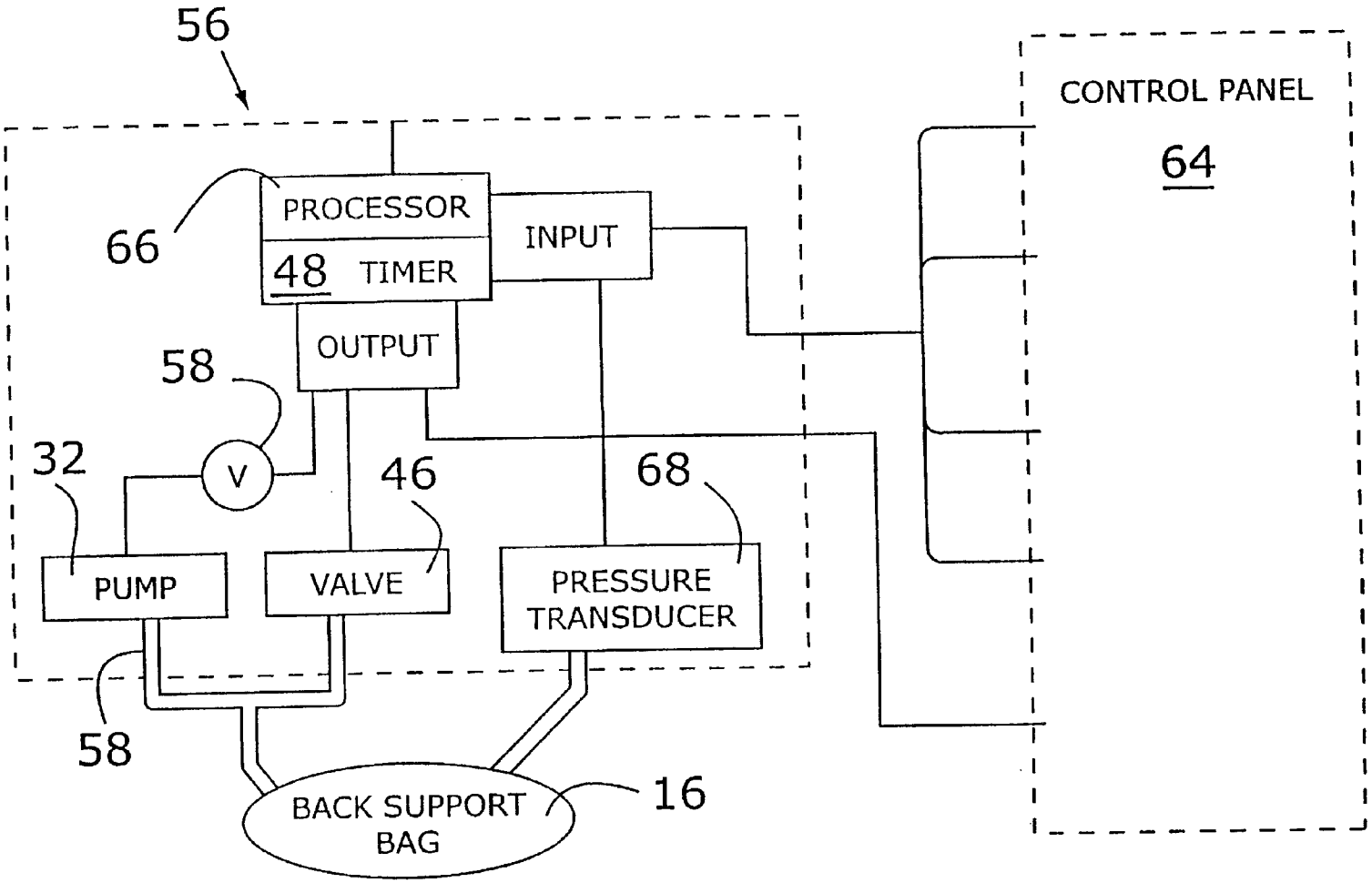
FIG. 7 is a schematic diagram of apparatus for cyclically providing a fluid supply for the fluid inflatable bag.

Referring to FIG. 7, the programmable circuitry 56 is comprised of a control panel 64 and a microprocessor 66 including the timer 48 that govern the electrically powered pump 32 and solenoid valve 46. The control panel 64 may be adapted for receiving user-adjustable cycle parameters, or alternatively for selecting predetermined cycle patterns. The user-adjustable cycle parameters may effectuated by use of the timer 48, and may include "High", "Medium" and "Low" pressure settings. The programmable circuitry 56 will adjust the voltage 58 supplied to the electrically powered pump 32, and the operation of solenoid valve 46 in a manner responsive to the user-adjustable cycle parameters or predetermined cycle patterns. For example, a "Low" pressure setting could be implemented through a short cycle duration and low fluid flow rate. Alternatively, a "High" pressure setting could be implemented through a long cycle duration and high fluid flow rate. In another embodiment of the control panel 64 (also shown in FIG. 7), the user-adjustable cycle parameters of cycle duration and fluid flow rate may be separately controlled.

In another aspect, the apparatus may further comprise a force feedback mechanism comprising a pressure transducer 68 (shown in FIGS. 2 and 7) which is in fluid communication with the fluid inflatable bag 16. A preferred pressure transducer 68 is a silicon wafer providing a control voltage proportional to the pressure in the fluid inflatable bag 16. Alternatively, the pressure transducer 68 may be positioned to continuously monitor the force exerted by the back engaging surface 40 on the lower back 36 of the person 38. The pressure transducer 68 transmits an output regarding the force to the microprocessor 66. Using feedback from the pressure transducer 68, the microprocessor 66 can appropriately open or close solenoid valve 46 and either turn the electrically powered pump 32 on or off, or adjust the voltage 58 supplied to the electrically powered pump 32, thereby controlling flow of the fluid in conduit 22 and, therefore, inflation or deflation of the fluid inflatable bag 16.

Another aspect of the invention is a method for providing continuous passive motion back support for a person 38. The steps of the method include providing the fluid-inflatable bag 16 having a force-applying back engaging surface 40 connected to an electrically-powered pump 32 for inflating the fluid-inflatable bag 16, positioning the fluid-inflatable bag 16 behind and adjacent to the lower back 36 of the person 38, the force-applying back engaging surface 40 of the fluid-inflatable bag 16 adjacent to the lower back 36 of the person 38 when so positioned, and cyclically inflating the fluid-inflatable bag 16 by adjusting a voltage 58 supplied to the electrically-powered pump 32 pumping fluid into the fluid-inflatable bag 16 and deflating the fluid-inflatable bag 16 by allowing fluid to flow out from the fluid-inflatable bag 16, thereby cyclically varying forces applied to the lower back 36 of the person 38, thereby moving vertebrae 70 of the person 38 through a substantial range of extents of lordosis.

Multiple-Bag Embodiments

Figure 9:
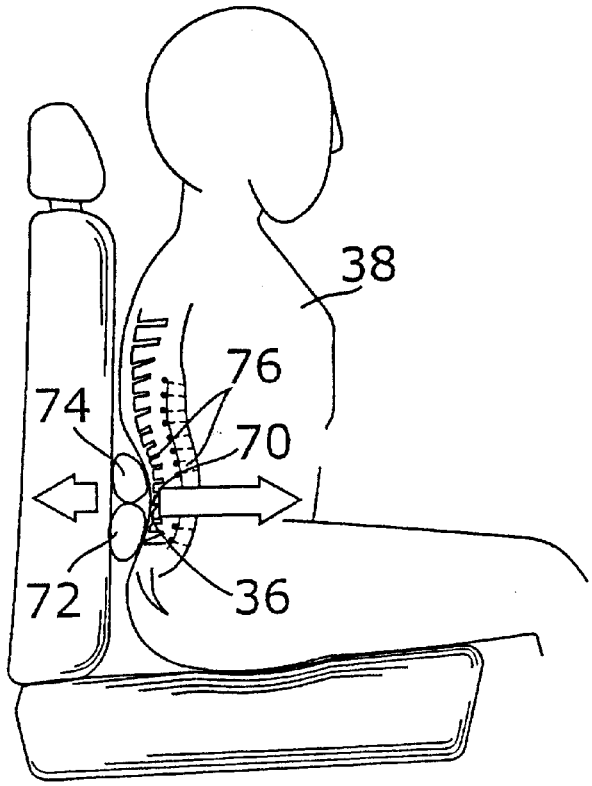
FIG. 9 is a perspective view showing a seated two-bag embodiment of the invention.

Another aspect of the invention is, as illustrated in FIG. 9, an improved apparatus for continuous passive motion provided by two fluid inflatable bags (72 and 74), situated above and below one another adjacent to the lower back 36 of a seated person 38, or with the same orientation relevant to a supine person's anatomy. The applicant has previously disclosed a multiple bag embodiment wherein one bag is selected for operation based upon the height at which CPM is desired. Disclosed herein is the simultaneous use of the two fluid inflatable bags (72 and 74), in close enough proximity that their inflation and deflation alternately, or in a variety of sequences, move specific segments of vertebrae 70 in a more specific pattern than was capable in earlier designs. Cycling at intervals greater than five seconds, and inflating the fluid inflatable bags (72 and 74) to appropriate volumes and pressures, accomplish more than just massaging soft tissues—segmental spinal motion is effected.

Figure 10:
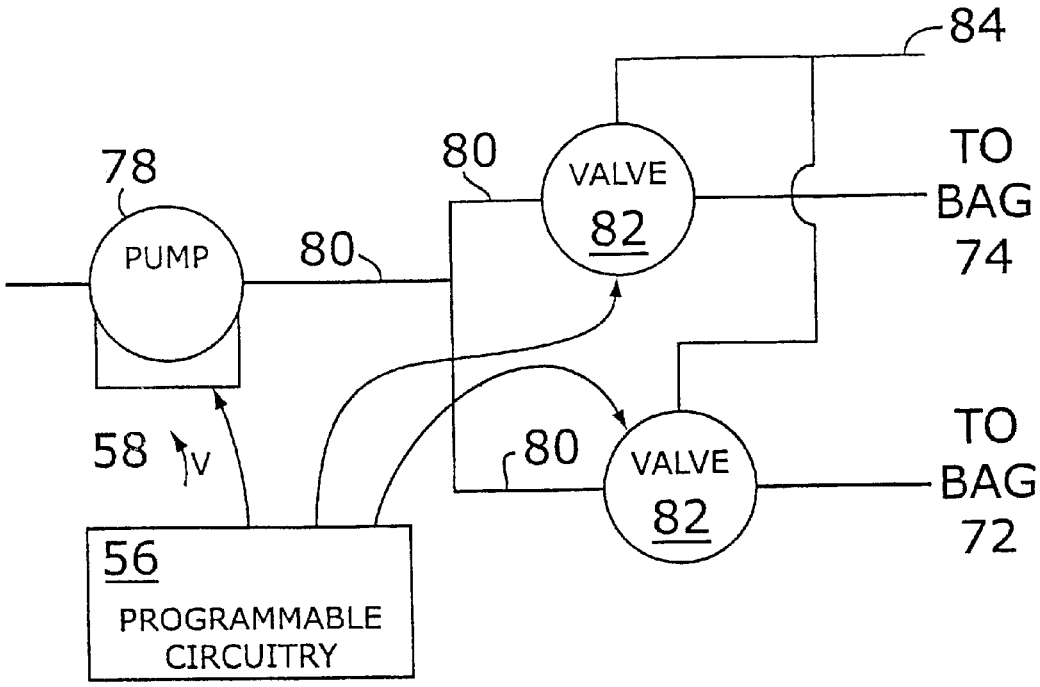
FIG. 10 is a schematic diagram of a multiple-bag embodiment of the invention.

First fluid inflatable bag 72 and second fluid inflatable bag 74 each include a back engaging surface 76 and each is independently and cyclically inflatable and deflatable. Inflation and deflation of first fluid inflatable bag 72 and second fluid inflatable bag 74 result in moving their respective back engaging surfaces 76, thereby cycling the lower back 36 through a substantial range of lordosis. Specific user selected sequences, or alternatively, predetermined cycle patterns, of inflation and deflation of the first fluid inflatable bag 72 and the second fluid inflatable bag 74 may vary the lordotic motion effected. Referring to FIG. 10, a pump 78 provides fluid from a reservoir or the atmosphere through a plurality of supply conduits 80 and two (normally open) solenoid valves 82 to first fluid inflatable bag 72 and second fluid inflatable bag 74. Programmable circuitry 56, as described in the previous section, is adapted to regulate the flow of fluid in the plurality of conduits 80 by controlling the operation of the pump 78 and the two solenoid valves 82, thereby controlling the independent inflation and deflation cycles and inflation pressures of the first fluid inflatable bag 72 and the second fluid inflatable bag 74. At least one exhaust conduit 84 is adapted to conduct fluid between both the first fluid inflatable bag 72 and second fluid inflatable bag 74 and the reservoir or atmosphere during the deflation cycle.

In another embodiment, the programmable circuitry 56 regulates the flow of fluid through the plurality of conduits 80 by controlling the operation of the two solenoid valves 82 and adjusting a voltage 58 supplied to the pump 78, which is preferably an electrically powered pump. The programmable circuitry 56 could also include a control panel 64 adapted to receive user adjustable cycle parameters as described in the subsection above.

Although the embodiment described here comprises two fluid inflatable bags, one skilled in the art will be able to devise embodiments of more than two fluid inflatable bags. Such embodiments require use of additional conduits and solenoid valves, if independent control and a greater selection of inflation and deflation patterns are desired. Additionally, embodiments in which more than one pump is employed are also envisioned, reducing wear and prolonging the useful life of the pumps used in such embodiments.

Baseline Support Pressure with CPM

Figure 5:
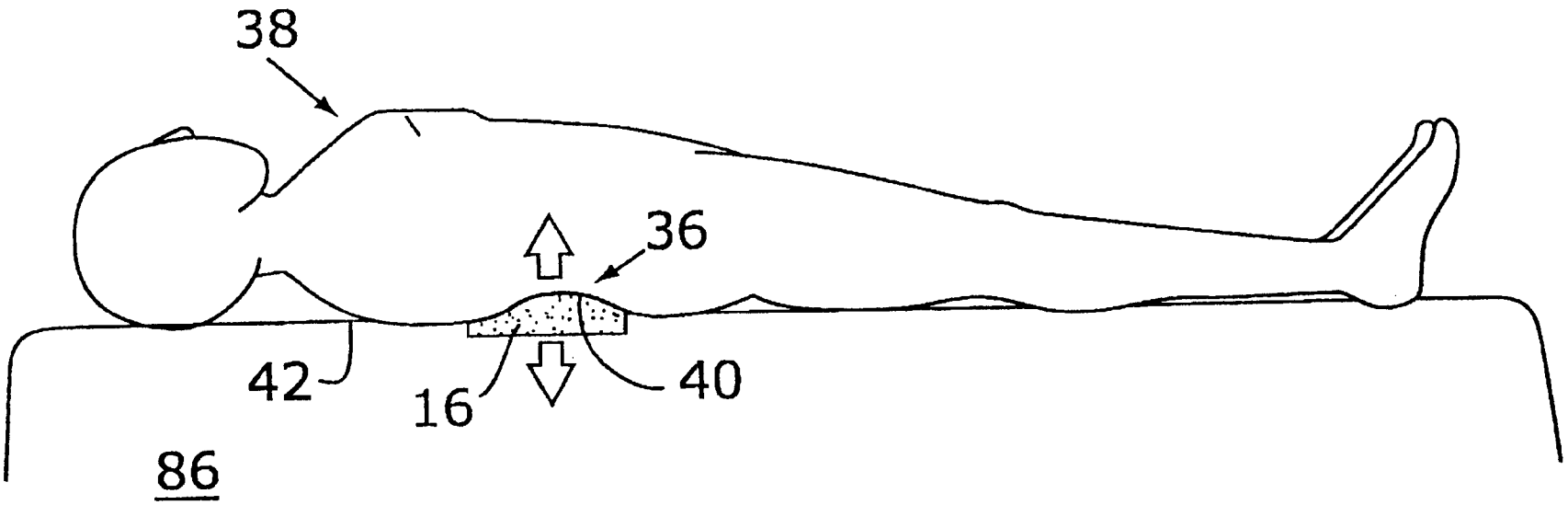
FIG. 5 is a perspective view showing a single-bag supine embodiment for providing continuous passive motion to the lower back of a person.

Another aspect of the invention is an apparatus and a method for providing a baseline support pressure during continuous passive motion. Through experience with the Back-Cycler™, a commercial device embodying the previous inventions and available from Ergomedics, Inc. of Winooski, Vt., assignee of the present application, the inventor has learned that users desire different amounts of back support at the end of a deflation cycle. The previously patented designs disclosed only control over a maximum delivery pressure within a fluid inflatable bag 16. In a seated position, and especially in a supine position, such as illustrated in FIG. 5, however, the presence of too much lumbar support or the sense of some firm platform 42 from which the BackCycler™ can exert force against the person 38 could be found uncomfortable.

In a preferred embodiment, and referring to FIG. 7, the single-bag apparatus described above further comprises a control panel 64 adapted to receive a user selected baseline support pressure setpoint. The baseline support pressure refers to an adjustable minimum pressure in the fluid inflatable bag 16 at the end of the deflation cycle. The microprocessor 66 will, based upon the user's selection of a comfortable baseline support pressure setpoint and the output from the pressure transducer 68, regulate the flow of fluid in the conduit 22 by controlling the operation of solenoid valve 46 and electrically powered pump 32 in order to prevent the pressure in the fluid inflatable bag 16 from falling below the baseline support pressure setpoint. Cyclic continuous passive motion is applied above the baseline support pressure. This embodiment finds particularly useful application in the supine embodiment depicted in FIG. 5, such as in bedding 86, but can be equally applied in a seated embodiment (such as depicted in FIGS. 4*a* and 4*b*).

Figure 11:
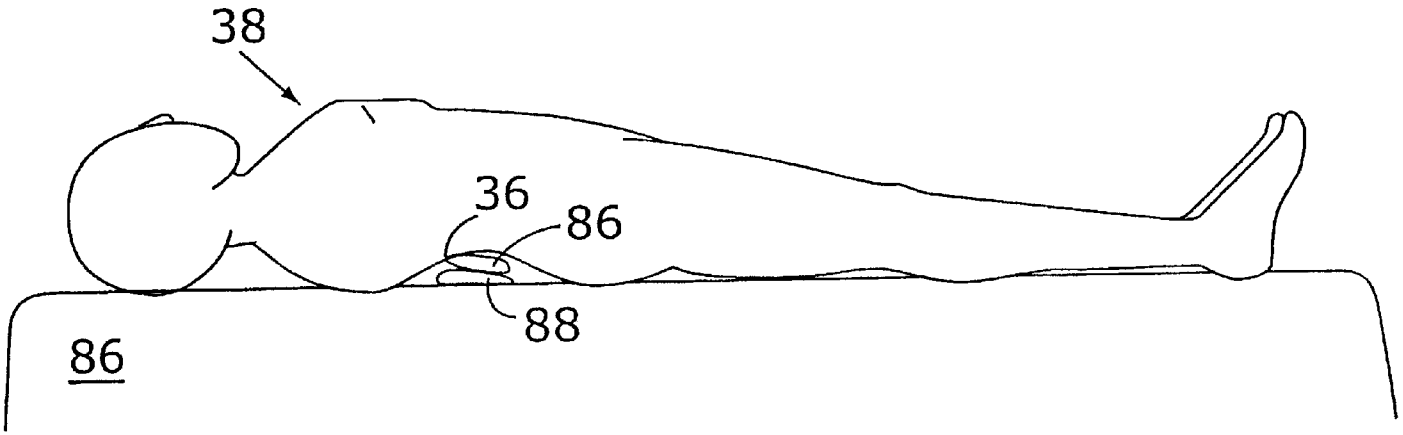
FIG. 11 is a perspective view showing a two-bag supine embodiment for providing baseline support pressure during continuous passive motion.

In another embodiment, the multiple-bag apparatus described above further comprises a primary fluid inflatable bag 86 and a secondary fluid inflatable bag 88 arranged in a layered configuration perpendicular to the lower back 36 of the person 38, as shown in FIG. 11. The primary fluid inflatable bag 86 may be inflated to a comfortable baseline support pressure and held constant. This may be achieved by selecting a cycle duration for the primary fluid inflatable bag 86 of sufficient length of time whereby the pressure within the primary fluid inflatable bag 86 achieves a static state. The secondary fluid inflatable bag 88 may then be operated in the usual CPM fashion. In another embodiment, the positions of the primary fluid inflatable bag 86 and secondary fluid inflatable bag 88 are interchanged. One skilled in the art could envision adding more fluid inflatable bags to provide either additional baseline support pressure or continuous passive motion.

Figure 12:
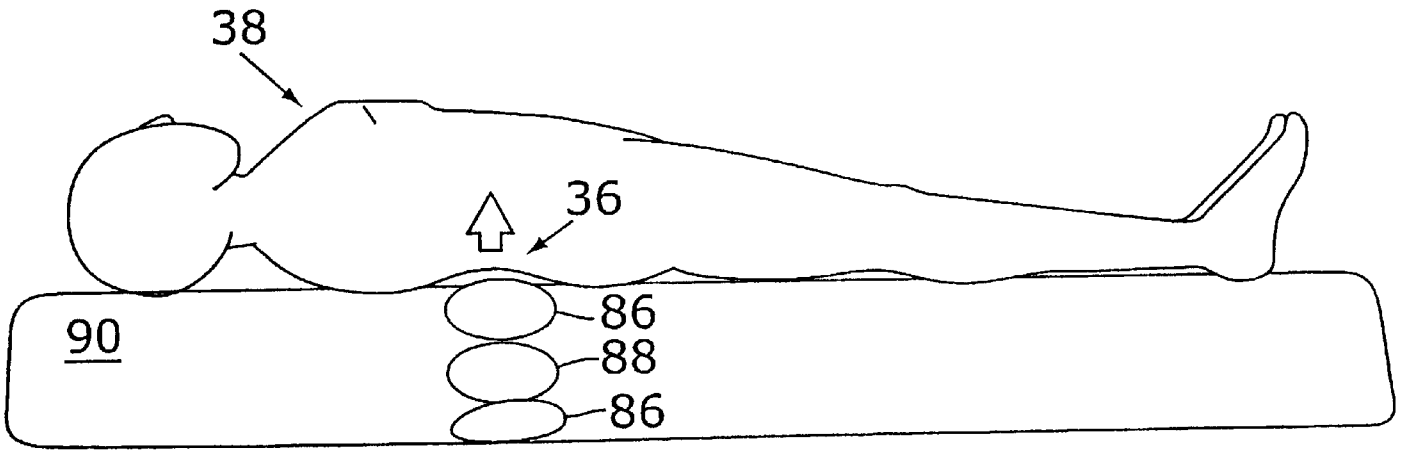
FIG. 12 is a perspective view showing a flippable mattress embodiment.

In a preferred embodiment depicted in FIG. 12, the multiple-bag apparatus described above further comprises two primary fluid inflatable bags 86 and one secondary fluid inflatable bag 88, which may be positioned within a flippable mattress 90, in a layered configuration perpendicular to the lower back 36 of the person 38, with one of each of the two primary fluid inflatable bags 86 located on each side of the secondary fluid inflatable bag 88. Preferably, the secondary fluid inflatable bag 88 provides continuous passive motion, while the primary fluid inflatable bags 86 provide baseline support pressure to the lower back 36 of the person 38. However, because the cycle parameters of each bag (86 and 88) is independently controllable, the continuous passive motion and/or baseline support pressure could be provided by any of the bags (86 or 88).

Another aspect of the invention is a method for providing a baseline support pressure during continuous passive motion for the lower back 36 of a person 38. Referring to FIGS. 7, 4*a* and 4*b*, the steps comprising the method include providing a fluid-inflatable bag 16 including a force-applying back engaging surface 40 connected to a pump 32 for inflating the fluid-inflatable bag 16 by means of a flow of a fluid supplied from a reservoir or the atmosphere through a conduit 22, providing programmable circuitry 56 adapted to control operation of the pump 32, positioning the fluid-inflatable bag 16 behind the lower back 36 of the person 38, the fluid-inflatable bag 16 being adjacent to the lower back 36 with its force-applying back engaging surface 40 adjacent to the lower back 36 of the person 38 when so positioned, inflating the fluid-inflatable bag 16 to a desired minimum support pressure with the fluid pumped by the pump 32, controlling the operation of the pump 32 by means of the programming circuitry 56, thereby controlling a cyclic flow of the fluid in the conduit 22 and a cycle of inflation of the fluid-inflatable bag 16 and deflation to no less than the desired minimum support pressure, thereby cyclically varying forces applied to the lower back 36 moving the vertebrae 70 through a substantial range of extents of lordosis while providing a baseline support pressure in the fluid inflatable bag 16.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. Apparatus for continuous passive motion back support for a person comprising:

a substantially static structure for receiving the back of a person;

a fluid-inflatable bag disposed adjacent to the static structure, the fluid-inflatable bag including a back-engaging surface cyclically moveable to increase and decrease the distance between the static structure and the back-engaging surface thereby cycling the lower back of the person through a substantial range of lordosis;

an electrically-powered pump connected to a reservoir or the atmosphere for supplying a fluid to the fluid-inflatable bag;

a supply conduit adapted to conduct the fluid between the reservoir or the atmosphere and the fluid-inflatable bag; and programmable circuitry for adjusting a voltage supplied to the electrically-powered pump, whereby fluid flow in the conduit is effected by adjustably controlling the electrically-powered pump.

2. The apparatus of claim 1, wherein the programmable circuitry adjusts the voltage through pulse width modulation.

3. The apparatus of claim 1, wherein the programmable circuitry adjusts the voltage through use of a potentiometer.

4. The apparatus of claim 1, wherein the programmable circuitry is further comprised of a control panel adapted to receive user-adjustable cycle parameters.

5. The apparatus of claim 4, wherein the programmable circuitry adjusts the voltage supplied to the electrically-powered pump in a manner responsive to user-adjustable cycle parameters.

6. The apparatus of claim 4 wherein the user-adjustable cycle parameters include a duration of an inflation and deflation cycle.

7. The apparatus of claim 4 wherein the user-adjustable cycle parameters include a rate of fluid-inflatable bag inflation.

8. The apparatus of claim 4 wherein the user-adjustable cycle parameters include an inflation pressure.

9. The apparatus of claim 1, further comprising a check valve adapted to protect against inappropriate entrance of fluid into the system through the conduit.

10. The apparatus of claim 1, further comprising a transducer adapted to monitor the force exerted by the back engaging surface on the back of the person and to transmit an output regarding the force to the programmable circuitry.

11. The apparatus of claim 10, wherein the programmable circuitry adjusts the voltage supplied to the electrically-powered pump in response to the output transmitted from the transducer, whereby the programmable circuitry regulates the flow of the fluid in the conduit.

12. The apparatus of claim 1, further comprising an exhaust conduit adapted to conduct the fluid between the supply conduit and the reservoir or atmosphere through a solenoid valve.

13. The apparatus of claim 12, wherein the programmable circuitry regulates the flow of the fluid in the exhaust conduit by additionally closing the solenoid valve, thereby regulating inflation of the fluid-inflatable bag.

14. The apparatus of claim 12, wherein the programmable circuitry regulates the flow of the fluid in the exhaust conduit by additionally opening the solenoid valve, thereby regulating deflation of the fluid-inflatable bag.

15. The apparatus of claim 1, wherein the fluid comprises air.

16. The apparatus of claim 1, wherein the programmable circuitry includes a timer for timing an inflation interval.

17. The apparatus of claim 1, wherein the programmable circuitry includes a timer for timing a deflation interval.

18. The apparatus of claim 1, further comprising a valve adapted for adjustably limiting a rate of fluid flow in the conduit during inflation.

19. Method for providing continuous passive motion back support for a person, comprising the steps of:

providing a fluid-inflatable bag having a force-applying portion connected to an electrically-powered pump for inflating the fluid-inflatable bag;

positioning the fluid-inflatable bag behind and adjacent to the lumbar region of the person, the force-applying portion of the fluid-inflatable adjacent to the lumbar region of the spine of the person when so positioned; and cyclically inflating the fluid-inflatable bag by adjusting a voltage supplied to the electrically-powered pump pumping fluid into the fluid-inflatable bag and deflating the fluid-inflatable bag by allowing fluid to flow out from the fluid-inflatable bag, thereby cyclically varying forces applied to the spine of the person moving the spine through a substantial range of extents of lordosis.

20. Apparatus for treating or preventing low backpain in a person, comprising:

a fluid-inflatable bag having a force-applying portion, the bag adapted to be positioned behind and adjacent the lumbar region of the person, the force-applying portion adjacent to the lumbar region of the spine when the bag is so positioned;

a source of fluid under pressure;

a conduit adapted to conduct the fluid between the source and the bag;

a control panel including means to select a maximum inflation pressure and a minimum baseline pressure; and a regulator adapted for controlling flow of the fluid in the conduit, the flow of the fluid cyclically causing inflation and deflation of the fluid-inflatable bag between the maximum inflation pressure and the minimum baseline pressure, the regulator thereby controlling the pressure of the fluid in the bag, the inflation and deflation of the bag thereby cyclically moving the spine through a substantial range of extents of lordosis, the regulator further adapted to prevent the pressure of the fluid in the bag from dropping below the selected pressures.

21. Apparatus for continuous passive motion back support for a person comprising;

a substantially static structure for receiving the back of a person;

two or more fluid-inflatable bags disposed adjacent to static structure, the fluid-inflatable bags each including a back-engaging surface independently and cyclically moveable to increase and decrease the distance between the static structure and each back-engaging surface thereby to cycle the lower back through a substantial range of lordosis;

a pump connected to a reservoir or the atmosphere for supplying a fluid to the fluid-inflatable bags;

a number of supply conduits adapted to conduct the fluid between the reservoir or the atmosphere and the two or more fluid-inflatable bags;

at least one exhaust conduit adapted to conduct the fluid between the two or more fluid-inflatable bags and the reservoir or the atmosphere;

a number of solenoid valves equal to a number of the two or more fluid-inflatable bags for which independent inflation control is desired, the number of solenoid valves disposed between the number of supply conduits and the at least one exhaust conduit; and programmable circuitry for adjustably controlling a voltage supplied to the pump and individually controlling the number of solenoid valves, thereby controlling flow of the fluid in the number of supply conduits and the at least one exhaust conduit, the flow of the fluid cyclically causing inflation and deflation of the two or more fluid-inflatable bags, the programmable circuitry thereby controlling the pressures of the fluid in the two or more fluid-inflatable bags.

22. The apparatus of claim 21, wherein the pump further comprises an electrically-powered pump supplied with a voltage.

23. The apparatus of claim 21, wherein the programmable circuitry controls the operation of the electrically-powered pump by turning the pump on or off.

24. The apparatus of claim 21, wherein the programmable circuitry controls the operation of the electrically-powered pump by adjusting the voltage supplied to the electrically-powered pump.

25. The apparatus of claim 21, wherein the programmable circuitry is further comprised of a control panel adapted to receive user-adjustable cycle parameters for each of the two or more fluid-inflatable bags.

26. The apparatus of claim 25, wherein the programmable circuitry adjusts the voltage supplied to the electrically-powered pump in a manner responsive to the user-adjustable cycle parameters.

27. The apparatus of claim 25, wherein the user-adjustable cycle parameters include a duration of an inflation and deflation cycle for each of the two or more fluid-inflatable bags.

28. The apparatus of claim 27, wherein a duration of an inflation cycle for one or more of the two or more fluid-inflatable bags is adjusted to a maximum whereby the one or more of the two or more fluid-inflatable bags provides a static baseline support pressure to the back of the person.

29. The apparatus of claim 28, wherein the two or more fluid-inflatable bags comprise three bags arranged in a layered manner perpendicular to back of the person, and wherein a middle bag provides static baseline support pressure, and either of the other bags provide continuous passive motion to the back of the person.

30. The apparatus of claim 25, wherein the user-adjustable cycle parameters include a rate of fluid-inflatable bag inflation for each of the two or more fluid-inflatable bags.

31. The apparatus of claim 25, wherein the user-adjustable cycle parameters include an inflation pressure for each of the two or more fluid-inflatable bags.

32. Method for providing a baseline support pressure during continuous passive motion for the back of a person, comprising the steps of:

providing a fluid-inflatable bag including a force-applying portion connected to a pump for inflating the fluid-inflatable bag with a flow of a fluid supplied from a reservoir or the atmosphere through a conduit;

providing programmable circuitry for adjustably controlling the pump;

providing a control panel including means to select a maximum inflation pressure and a minimum baseline pressure;

positioning the fluid-inflatable bag behind the lumbar region of the person, the fluid-inflatable bag being adjacent to the lumbar region of the person with its force-applying portion adjacent to the lumbar region of the spine of the person when so positioned;

selecting a maximum inflation pressure and a minimum baseline support pressure;

inflating the fluid-inflatable bag to the desired minimum baseline support pressure with the fluid pumped by the pump; and controlling the operation of the pump by means of the programming circuitry, thereby controlling a cyclic flow of the fluid in the conduit and a cycle of inflation of the fluid-inflatable bag to the maximum inflation pressure and deflation to no less than the desired minimum support pressure, thereby cyclically varying forces applied to the spine of the person moving the spine through a substantial range of extents of lordosis while providing a baseline support pressure in the bag.

* * * * *